US008146760B1

(12) United States Patent
Leach

(10) Patent No.: US 8,146,760 B1
(45) Date of Patent: Apr. 3, 2012

(54) BABY BOTTLE WITH TUBULAR GRIPPING SECTIONS

(76) Inventor: Jamie S. Leach, Ada, OK (US)

( * ) Notice: Subject to any disclaimer, the term of this patent is extended or adjusted under 35 U.S.C. 154(b) by 329 days.

(21) Appl. No.: 12/540,678

(22) Filed: Aug. 13, 2009

Related U.S. Application Data

(60) Provisional application No. 61/090,775, filed on Aug. 21, 2008, now abandoned.

(51) Int. Cl.
*A61J 9/08* (2006.01)

(52) U.S. Cl. ..... 215/398; 215/11.1; 215/385; 220/771; 220/772

(58) Field of Classification Search ..... 215/375, 215/377, 385, 398, 399, 11.6, 384; D9/608, D9/73, 533, 530; D24/197, 198; 220/775, 220/757, 771, 772; 224/926; 248/102
See application file for complete search history.

(56) References Cited

U.S. PATENT DOCUMENTS

| | | | | | |
|---|---|---|---|---|---|
| 2,793,778 | A | | 5/1957 | Maxwell | |
| 3,232,495 | A | * | 2/1966 | Schueider | 222/209 |
| 3,395,836 | A | | 8/1968 | Stahmer | |
| 3,443,710 | A | * | 5/1969 | Hills | 215/385 |
| D214,549 | S | | 7/1969 | Ledewitz | |
| 3,920,140 | A | * | 11/1975 | Kiser | 215/399 |
| D254,235 | S | | 2/1980 | Hartung | |
| 4,193,699 | A | | 3/1980 | Haygeman et al. | |
| 4,570,808 | A | * | 2/1986 | Campbell et al. | 215/11.1 |
| 4,700,856 | A | * | 10/1987 | Campbell et al. | 215/11.3 |
| 4,765,514 | A | | 8/1988 | Berglund | |
| D297,961 | S | * | 10/1988 | Egger | D21/682 |
| 4,813,556 | A | | 3/1989 | Lawrence | |
| 4,834,459 | A | | 5/1989 | Leach | |
| D302,656 | S | | 8/1989 | Green | |
| 4,861,109 | A | | 8/1989 | Leach | |
| D303,496 | S | | 9/1989 | Larson | |
| D309,018 | S | | 7/1990 | Leach | |
| 4,969,922 | A | | 11/1990 | Platte, Sr. | |
| D321,130 | S | | 10/1991 | Goberman | |
| D321,936 | S | * | 11/1991 | Donovan | D24/197 |
| 5,103,514 | A | | 4/1992 | Leach | |
| D330,939 | S | * | 11/1992 | Imai | D24/198 |
| D336,685 | S | * | 6/1993 | Hsu | D24/197 |
| D337,921 | S | | 8/1993 | Iodice | |
| 5,320,231 | A | | 6/1994 | Iodice | |
| 5,325,818 | A | | 7/1994 | Leach | |
| D357,542 | S | | 4/1995 | Vaichis | |
| 5,419,447 | A | | 5/1995 | Lim | |
| 5,660,301 | A | | 8/1997 | Kaplowitz | |
| D385,748 | S | | 11/1997 | Iodice et al. | |
| D398,237 | S | | 9/1998 | Walter | |
| D404,492 | S | | 1/1999 | Demery | |

(Continued)

*Primary Examiner* — Sue Weaver
(74) *Attorney, Agent, or Firm* — Mary M. Lee

(57) ABSTRACT

A baby bottle comprising an asymmetrically divided lower portion continuous with a common upper portion that is attachable to a nipple assembly. The upper portion and lower portion together define a single, continuous fluid chamber. The upper portion includes an open top providing access to the fluid chamber. The lower portion comprises first and second side-by side tubular sections together defining a central opening between them and through the bottle. The central opening is sized to receive the hand of a nursing child so that each of the first and second tubular sections is alternately grippable by the child nursing from the bottle. The diameter of the first tubular section is greater than the diameter of the second tubular section so that the bottle is grippable by different sized hands, that is, by infants and toddlers of different ages and sizes.

9 Claims, 2 Drawing Sheets

U.S. PATENT DOCUMENTS

| | | | | |
|---|---|---|---|---|
| D430,798 | S | 9/2000 | Stevens et al. | |
| 6,179,166 | B1 | 1/2001 | Dallas, Jr. | |
| 6,343,727 | B1 | 2/2002 | Leach | |
| 6,427,251 | B1 | 8/2002 | Leach | |
| D464,139 | S | 10/2002 | Iodice | |
| 6,499,164 | B1 | 12/2002 | Leach | |
| D470,593 | S | 2/2003 | Iodice | |
| 6,553,590 | B1 | 4/2003 | Leach | |
| 6,601,252 | B1 | 8/2003 | Leach | |
| 6,695,163 | B2 * | 2/2004 | Michalowski | 215/398 |
| 6,751,817 | B1 | 6/2004 | Leach | |
| 6,760,934 | B1 | 7/2004 | Leach | |
| 7,010,821 | B1 | 3/2006 | Leach | |
| 7,114,206 | B2 | 10/2006 | Leach | |
| 7,331,478 | B2 | 2/2008 | Aljadi | |
| 7,353,552 | B2 | 4/2008 | Leach | |
| 7,500,278 | B2 | 3/2009 | Leach | |
| 7,513,001 | B1 | 4/2009 | Leach | |
| 7,562,406 | B1 | 7/2009 | Leach | |
| 2005/0278864 | A1 | 12/2005 | Leach | |
| 2007/0022526 | A1 | 2/2007 | Leach | |
| 2007/0028384 | A1 | 2/2007 | Leach | |
| 2007/0046084 | A1 | 3/2007 | Leach | |
| 2007/0151031 | A1 | 7/2007 | Leach | |
| 2007/0277321 | A1 | 12/2007 | Leach | |

* cited by examiner

BABY BOTTLE WITH TUBULAR GRIPPING SECTIONS

This application claims the benefit of the filing date of U.S. provisional application No. 61/090,775, entitled "Baby Bottle," and filed Aug. 21, 2008, the contents of which are incorporated herein by reference.

FIELD OF THE INVENTION

The present invention relates generally to baby bottles.

DETAILED DESCRIPTION OF THE PREFERRED EMBODIMENT(S)

The present invention comprises a baby bottle with an asymmetrically divided lower portion continuous with a common upper portion that is attachable to a nipple assembly. Because the lower portion is divided into different sized portions, the grip size is maximized for a wider range of infants and toddlers. In the preferred embodiment, the lower portion comprises two tubular sections with blind ends, as this facilitates cleaning of the bottle.

Figure 1:
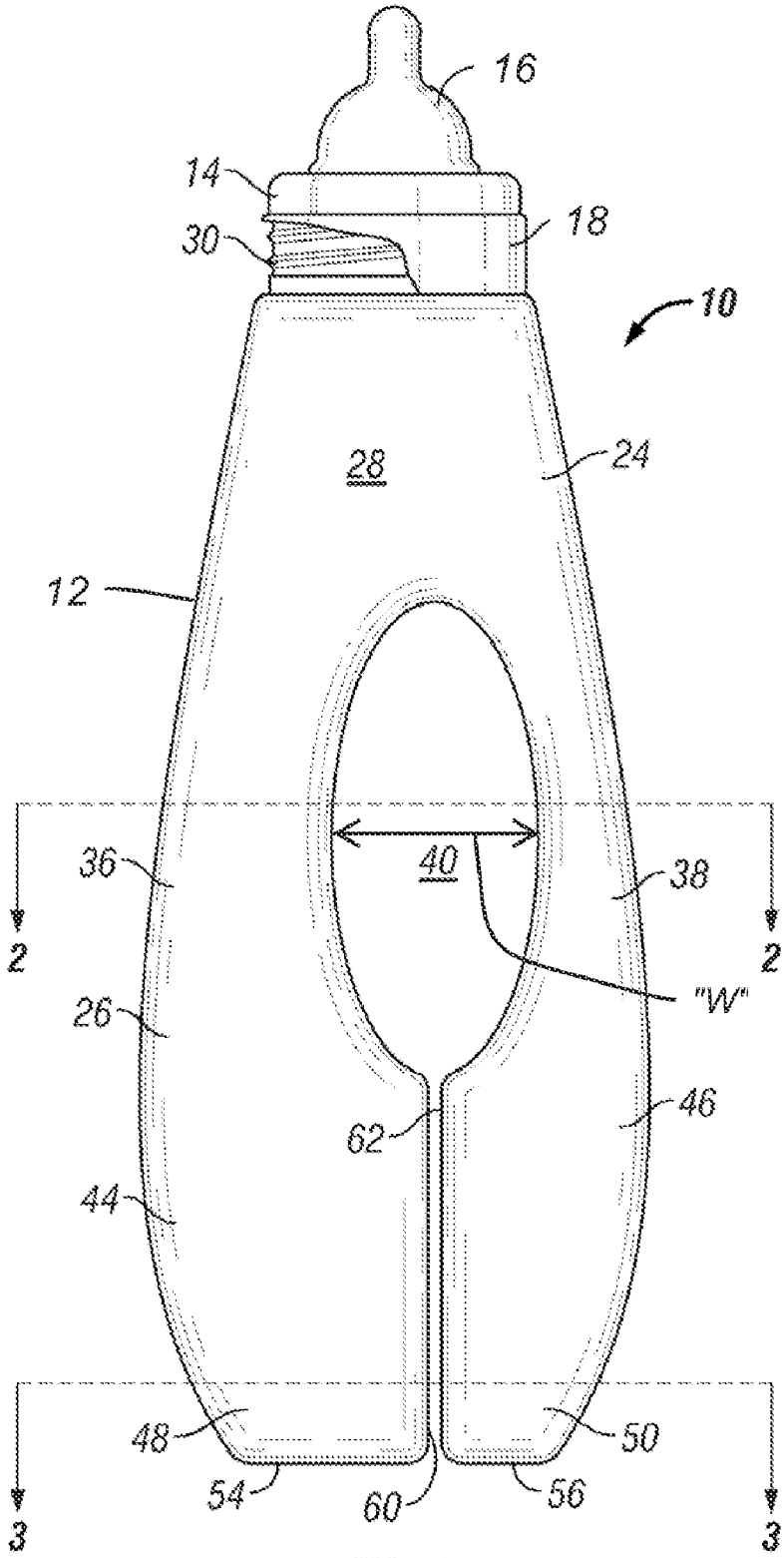
FIG. 1 is a side elevational view of a baby bottle made in accordance with the present invention.

Turning now to the drawings in general and to FIG. 1 in particular, there is shown therein a baby bottle made in accordance with a preferred embodiment of the present invention and designated generally by the reference numeral 10. The baby bottle 10 comprises a bottle 12 and a nipple assembly 14. The nipple assembly 14 may be conventional and generally comprises a nipple 16 and a cap 18.

The bottle 12 comprises an upper portion 24 and a lower portion 26 which together define a single, continuous fluid chamber 28. The upper portion 24 has an open top 30 providing access to the fluid chamber 28. The open top 30 is configured to allow the cap 18 to be removably connected thereto. Most typically, the cap 18 is threadedly connectable to the open top 30. In this way, all liquid in the bottle 12 may be removed through the nipple assembly 14 or through the open top 30 when the nipple assembly is removed.

The lower portion 26 of the bottle 12 comprises first and second side-by-side tubular sections 36 and 38 which together define a central opening 40 with a maximum width "W" between them and through the bottle. The central opening 40 is sized to receive the hand of a nursing child (not shown) so that each of the first and second tubular sections 36 and 38 is grippable by the child. The central opening 40 shown is oval, but the opening may take other shapes. Ribs, notches, buttons, dimples or the like may be provided on the tubular sections 36 and 38 to assist in gripping the bottle 10.

The diameter of the first tubular section 36 is greater than the diameter of the second tubular section 38 so that the bottle 10 is grippable by different sized hands. In this way, the same bottle 10 is sized for use by one child as he grows from an infant to a toddler. Or, since the bottle 10 preferably is washable and reusable, the bottle may be used by different aged children in the same household. Thus, it will be apparent that, as used herein, the word "child" includes infants and toddlers. It could also include older children that are delayed developmentally.

Figure 2:
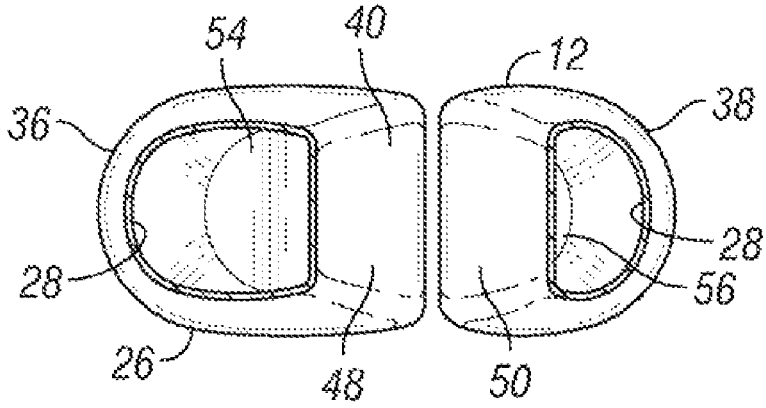
FIG. 2 is a cross-sectional view of the baby bottle of FIG. 1 taken along line 2-2.

The cross-sectional shape of the tubular sections 36 and 38 may vary. In the embodiment shown in FIGS. 1-3, the cross-sectional shape is roughly D-shaped. See especially FIG. 2. Accordingly, the term "diameter" as used herein denotes only generally the greatest cross-sectional dimension, and does not indicate that the tubular sections are necessarily cylindrical in shape.

Preferably, as shown in FIG. 1, the overall configuration of the bottle 12 is generally C-shaped or U-shaped, that is, the tubular sections 36 and 28 have end portions 44 and 46 that terminate in blind ends 48 and 50. Preferably, the blind ends 48 and 50 have flat bottoms 54 and 56. The bottoms 50 and 52 are shown co-planar, but this is not essential. It is, of course, highly desirable that the bottom of the bottle 12 have some flat surface so that it can stand upright on a table or other surface.

Figure 3:
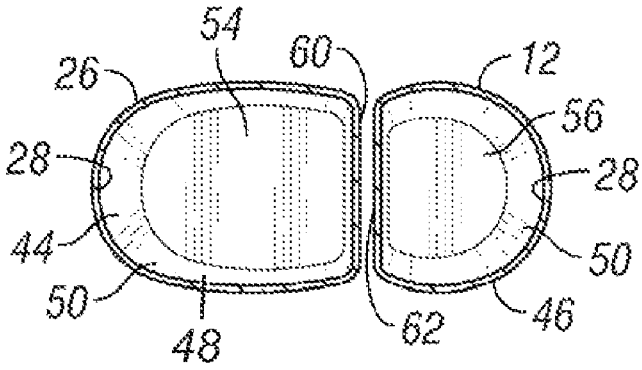
FIG. 3 is a cross-sectional view of the baby bottle of FIG. 1 taken along line 3-3.

Still further, as shown in FIGS. 1 and 3, each of the end portions 44 and 46 comprises a planar face 60 and 62 (identified in FIG. 3) on its inner aspect. The planar faces 60 and 62 preferably are positioned in parallel and face-to-face arrangement below the central opening 40. The faces 60 and 62 may abut each other, but preferably are spaced a small distance apart, such as about one-fourth to one-half inch.

It will be appreciated that the divided lower portion 26 may take other shapes. For example, instead of being side-by-side, the end portions 44 and 46 could be arranged with one in front of the other. Still further, one end portion could be curled inside and above the other end portion, so that only the lowest end portion had a flat bottom.

The methods and materials for making baby bottles are well known and will not be described in detail herein. Preferably, the bottle is integrally formed, and most preferably will be formed of a plastic material. However, in some instances, glass or other ceramic or composite materials may be used. Similarly, each of the cap and nipple is integrally formed of a suitable plastic. This provides a baby bottle that is lightweight, washable, reusable, food safe, and unbreakable. The surface of the bottle 12 or nipple assembly 14 may be provided with ornamentation.

Now it will be seen that the bottle 10 may be held by gripping either the larger first tubular section 36 or the smaller tubular section 38, or both, with the fingers of the hands extending through the central opening 40. This handle opening 40 permits the bottle 10 to be held by a much smaller hand than could comfortably grip the entire lower portion 26 of the bottle 10. Moreover, because the lower portion 26 is divided into different sized tubular sections 36 and 38, the bottle 10 accommodates the grip size of a wide range of infants.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only. Changes may be made in the details, especially in matters of shape, size, and arrangement of the parts within the principles of the inventions to the full extent indicated by the broad meaning of the terms of the attached claims. The description and drawings of the specific embodiments herein do not point out what an infringement of this patent would be, but rather provide an example of how to use and make the invention. The limits of the invention and the bounds of the patent protection are measured by and defined in the following claims.

What is claimed is:

1. A baby bottle comprising;

a bottle comprising an upper portion and a lower portion, wherein the upper and lower portions together define a single, continuous fluid chamber, wherein the upper portion includes an open top providing access to the fluid chamber, wherein the lower portion comprises first and second side-by side tubular sections together defining a central opening between them and through the bottle, the central opening sized to receive the hand of a nursing child so that each of the first and second tubular sections is grippable by the child, and wherein the diameter of the first tubular section is greater than the diameter of the second tubular section so that the bottle is grippable by different sized hands; and a nipple assembly comprising a nipple and a cap, the cap being removably connectable to the open top of the bottle.

2. The baby bottle of claim 1 wherein the bottle is integrally formed of plastic.

3. The baby bottle of claim 1 wherein the fluid chamber is generally C-shaped so that each tubular section has a blind end.

4. The baby bottle of claim 3 wherein each of the tubular sections terminates in a flat bottom, the bottoms being coplanar.

5. The baby bottle of claim 3 wherein each of the tubular sections comprises a lower portion, each such lower portion including a planar face, the planar faces of the lower portions positioned in parallel face-to-face arrangement below the central opening, the faces being spaced a distance apart, wherein central opening has a maximum width and the distance between the planar faces is less than the maximum width of the central opening.

6. The baby bottle of claim 5 wherein the distance between the planar faces of the lower portions is less than about one-half inch.

7. The baby bottle of claim 5 wherein the distance between the planar faces of the lower portions is less than about one-fourth inch.

8. The baby bottle of claim 1 wherein the bottle and nipple assembly are washable and reusable.

9. The baby bottle of claim 1 wherein the central opening is oval.

* * * * *